US005835387A

United States Patent [19]

Shou et al.

[11] Patent Number: 5,835,387

[45] Date of Patent: Nov. 10, 1998

[54] MULTIPLICATION CIRCUIT

[75] Inventors: Gouliang Shou; Kazunori Motohashi; Sunao Takatori; Makoto Yamamoto, all of Tokyo, Japan

[73] Assignees: Yozan Inc., Tokyo; Sharp Kabushiki Kaisha, Osaka, both of Japan

[21] Appl. No.: 791,022

[22] Filed: Jan. 27, 1997

[30] Foreign Application Priority Data

Jan. 29, 1996 [JP] Japan ..... 8-034333
Mar. 19, 1996 [JP] Japan ..... 8-088931

[51] Int. Cl.[6] ..... G06J 1/00
[52] U.S. Cl. ..... 364/606
[58] Field of Search ..... 364/602, 606

[56] References Cited

U.S. PATENT DOCUMENTS 5,361,219 11/1994 Shou et al. .
5,381,352 1/1995 Shou et al. ..... 364/606
5,396,442 3/1995 Shou et al. .

*Primary Examiner*—Tan V. Mai
*Attorney, Agent, or Firm*—Cushman Darby & Cushman IP Group of Pillsbury Madison & Sutro LLP

[57] ABSTRACT

Multiplication is performed including accumulation at high speed by a small quantity of hardware. Analog voltage $X_i$ corresponding to each element of the first input data string is input to capacitance switching circuits $\mathbf{10}_1$ to $\mathbf{10}_n$ through input terminals $\mathbf{1}_1$ to $\mathbf{1}_n$. m bit of digital control data $A_i$ corresponding to each element of the second input data string are input to each capacitance switching circuit $\mathbf{10}_i$, and each bit $a_j$ of the control signal $A_j$ is input to the corresponding multiplexer circuit $\mathbf{6}_{ij}$. In the multiplexer circuit $\mathbf{6}_{ij}$, the capacitances $C_{ij}$ corresponding to the value of each bit of the control signal $a_j$ are connected to the input terminal $\mathbf{1}_i$ or the reference charge $V_{STD}$. The voltages corresponding to the products of inputted analog voltages $X_1$ and the control signals $A_i$ are outputted from each capacitance switching circuit $\mathbf{10}_j$. The output voltages of each capacitance switching circuit $\mathbf{10}_i$ are parallelly inputted to the operational amplifier 3 connected by a feedback capacitance Cf, and the sum of the input voltages is outputted from the operational amplifier 3. On the other hand, in order to provide a multiplication circuit of high calculation speed without deteriorating the calculation accuracy and circuit density, a multiplication circuit according to the present invention has a MOS switch or MOS multiplexer the MOS of which has a gate with width and length so that a time constant defined by the input capacitance and the switch etc. is constant.

2 Claims, 5 Drawing Sheets

MULTIPLICATION CIRCUIT

FIELD OF THE INVENTION

The present invention relates to multiplication circuit including accumulation for multiplying the corresponding elements of an analog input signal string and a digital data string, and outputting the summation of the result of the multiplication.

The present invention also relates to a multiplication circuit incorporated within an analog integrated circuit, which includes a plurality of input capacitances for weighting an input voltage. Inputs of the input capacitances are connected to MOS switches or MOS multiplexers and their outputs are commonly connected to a MOS inverter circuit with an odd number of MOS inverters. A feedback capacitance connects the input and output of the MOS inverter circuit.

BACKGROUND OF THE INVENTION

Multiplication circuits including accumulation are widely used in the field of signal processing for image processing, digital filtering, and correlation detecting processing. Generally, there are two types of computation circuits, analog and digital. As it is usually difficult to obtain the necessary accuracy of computation with analog circuits, digital circuits are widely used.

FIG. 2 shows an example of a digital accumulation and addition circuit. In this figure, 100 is a multiplier for inputting each element of the first input data string X ($x_1$, $x_2$ . . . $x_n$) and the second input data string A ($a_1$, $a_2$ . . . $a_n$) and to multiply the elements, 110 is an adder for inputting the outputs of the multiplier 100 and an accumulator 120, and 120 is the accumulator to store the output of the adder 110, to one of whose inputs it is connected, the output being the result of a computation of data accumulation and addition.

In the computational circuit structured above, first, the first data $x_1$ of the first input data string X and the first data $a_1$ of the second input data string A are multiplied in the multiplier 100, and the result of the multiplication $x_1 \cdot a_1$ is inputted to the adder 110. As the data of the accumulator 120 is initially 0, 0 is inputted from another input of the adder 110, from which $x_1 \cdot a_1$ is outputted and stored in the accumulator 120. Next, the second data $a_2$ and $x_2$ are multiplied in the multiplier 100, and the result of the multiplication $a_2 \cdot x_2$ is outputted to the adder 110. $a_1 \cdot x_1$ is inputted to another input of the adder 110, $a_1 \cdot x_1 + a_2 \cdot x_2$ is outputted from the adder 110 and stored in the accumulator 120. Similar multiplications and accumulations are performed sequentially, and consequently, $\Sigma(a_i \cdot x_i)$ (i=from 1 to n) is obtained in the accumulator 120.

Since a conventional digital multiplication circuit including accumulation has the above structure, it has been necessary to perform n times of multiplications and n−1 times of additions so as to perform the multiplication and accumulation of elements of two data strings, each of which includes n number of elements. Computation was time-consuming, and when signals were processed, there were many cases of one of the input signals being analog. Therefore, it has been necessary to convert beforehand an analog input signal to a digital one so as to perform the multiplication and accumulation by a digital circuit.

The applicants of this invention have already proposed a neural circuit with which it is possible to perform accurate and high-speed computations of analog signals and digital data with low electric power consumption. This neural circuit uses the ratio of capacitances; capacitance sizes are decided by the conductor areas formed on a semiconductor board, and the ratio of the conductor areas can be accurately controlled, allowing the realization of a computational circuit of high accuracy. Also it is possible to realize a circuit consuming low electric power, because it is driven solely by the voltage.

Such a neural circuit is described with reference to FIG. 3. FIG. 3(*a*) shows the basic structure of the neural circuit. In FIG. 3(*a*), 11 is an input terminal, 12 is an output terminal, and 13 is an operational amplifier which is structured by CMOS inverters connected in serial by several steps and other components, as described later. An input capacitance C1 is connected between the input terminal 11 and an input of the computational amplifier 13, a capacitance C2 is connected between an input of the operational amplifier 13 and a terminal 14 for connection to a reference potential $V_{STD}$, and a feedback capacitance Cf is connected between the input and the output of the operational amplifier 13.

In the circuit of the structure, an input voltage for the input terminal 11 is assumed to be Vi, and an output voltage obtained in an output terminal 12 is assumed to be Vout. As the voltage amplifying ratio of the computational amplifier 13 is very large, the voltage of point B at the input of the operational amplifier 13 is approximately constant. The voltage of point B is assumed to be Vb. Point B is connected to electrodes of capacitances C1, C2 and Cf and a gate electrode of the CMOS inverter of the first stage of the operational amplifier 3. It is assumed to be floating, and the electrical charge stored in each capacitance in the initial condition to be 0, and the total quantity of the electrical charge stored in each capacitance with referencing to point B is 0. Therefore, the electrical charge retention formula (1) is true:

$$C1(Vi-Vb)+C2(V_{STD}-Vb)+Cf(Vout-Vb)=0 \quad (1)$$

When it is assumed that the voltage Vb of point B is half of the supply voltage to be impressed to the operational amplifier 13, the dynamic range can be the largest. The voltage Vb is usually determined to be (½)Vdd when the supply voltage to be impressed to the operational amplifier 13 is +Vdd and the ground charge, and is determined to be 0 when the operational amplifier 13 is driven by the supply voltages +Vdd and −Vdd.

The reference charge $V_{STD}$ is usually deterimed to be $V_{STD}$=(½)Vdd, that is half of the voltage of the ground voltage ($V_{STD}$=0) or of the driving voltage of the operational amplifier 13.

When the reference charge $V_{STD}$ is the ground charge, the formula (1) becomes formula (2):

$$C1(Vi-Vb)+C2(0-Vb)+Cf(Vout-Vb)=0 \quad (2)$$

When the sum of the capacitances C1 and C2 is assumed to be equal to the capacity of the feedback capacitance Cf(Cf=C1+C2), and the voltage Vb of point B is (½)Vdd, formula (3) is derived from formula (2):

$$Vout = Vdd - \frac{C1}{Cf}\ Vi \quad (3)$$

The supply voltage Vdd is offset voltage, and (−C1/Cf) times the amount of the input voltage Vi is outputted from the output terminal. That is, the multiplication of the input voltage Vi and the ratio of capacitances (C1/Cf) can be performed by the circuit.

When the reference charge $V_{STD}$ is limited to be (½)Vdd (=Vb), formula (1) becomes formula (4).

$$C1(Vi-Vb)+Cf(Vout-Vb)=0 \quad (4)$$

Formula (5) can be obtained from formula (4):

$$Vout = Vb = -\frac{C1}{Cf}(Vi - Vb) \quad (5)$$

When the input voltage Vi and output voltage Vout is replaced by the voltage referencing the voltage Vb, and assuming that V'i=Vi−Vb, V'out=Vout−Vb, formula (5) becomes formula (6).

$$V'out = -\frac{C1}{Cf} V'i \quad (6)$$

The output voltage V'out of (−C1/Cf) times as amount of input voltage V'i can be obtained. That is, the multiplication of input voltage V'i and the capacitance ratio (C1/Cf) can be performed. In this case, the condition of C1+C2=Vf is not requisite, though it is necessary in the earlier case.

FIG. 3(*b*) shows an example of the neural multiplication circuit structure. To simplify the description, the same numbers in FIG. 3(*a*) are given to the component parts in FIG. 3(*a*), and the description with respect to the components given the same numbers in FIG. 3(*a*) is omitted. The component parts 15, 16 and 17 show the CMOS inverters, 18 and 19 are resistances and 20 is a capacitance. As shown in this figure, the inverters are used as operational amplifiers utilizing the transition parts of the inverter outputs, which range from high level to low level or from low level to high level. The number of inverter stages connected in serial is not limited to three. The necessary number can be decided according to each case. However, when there are too few stages, it is possible the predetermined gain cannot be obtained, and when there are too many, the propagation delay time is long and unstable oscillation is easily generated.

The resistances 18 and 19 and the capacitance 20 are set to prevent unstable oscillation. The gain of the operational amplifier is controlled by the resistances 18 and 19, and the phase is adjusted by the capacitance 20. With this it is possible to stably drive the circuit up to the high-frequency range.

As shown in formulas (3) and (6), the output voltage Vout is the voltage corresponding to the one (C1/Cf) times the amount of the input voltage Vi. Therefore, the output voltage Vout corresponding to the product of the first input data X and the second input data A can be obtained by setting the input voltage to be Vi, impressing the analog voltage corresponding to the first input data X, and changing the size of input capacitance C1 through receiving the second input data A as the control signal.

To make the multiplier changeable in this neural multiplication circuit, it is necessary to change the size of the input capacitances C1 and C2 by the control signal. FIG. 4 shows an exemplary structure of the capacitance switching circuit to change such capacitance size. This example shows the case where an analog input signal and 4-bit digital data are multiplied. It is possible to realize a neural multiplication circuit wherein the multiplier is changeable by replacing the capacitance switching circuit by the capacitances C1 and C2 in FIG. 3.

In FIG. 4, 11 is the input terminal, to which the input voltage Vi is impressed, and B is the input point of the operational amplifier 13. $C_1$, $C_2$, $C_3$ and $C_4$ are capacitances whose capacities are set so as to satisfy the relation of $C_4=2C_3=4C_2=8C_1$ and $C_1+C_2+C_3+C_4=Cf$.

p type MOSFETs 21, 22, 23 and 24 are provided between the input terminal 11 and each capacitance C1, C2, C3 and C4, respectively. p type MOSFETs 25, 26, 27 and 28 are connected between each connected point of MOSFETs 21, 22, 23 and 24 and the reference charge (that is, the ground charge), respectively. Four bits of the 0-order bit $a_0$, the first bit $a_1$, the second bit $a_2$ and the third bit $a_3$ of the control signal A are respectively input to the two gates of FET21 and FET25, FET22 and FET26, FET23 and FET27, and FET24 and FET28. That is, the FETs from 21 to 28 are analog switches opened and closed by control signals $a_0$ to $a_3$.

In this structure, according to the values of "1" or "0" of $a_0$ to $a_3$ of the four-bit control signal A, one of the connected n type MOSFETs or p type MOSFETs is conductive. Each capacitance $C_1$ to $C_4$ is connected to the input terminal 11 or the reference charge according to the bit value of the control signal. Therefore, the size of the capacitance to be connected to the input terminal and that of the capacitance to be connected to the reference charge are switched. The output voltage Vout is output to the output terminal 12 of the neural multiplication circuit corresponding to the product of the input voltage Vi and the capacity of the capacitance decided by the control signal.

The above exemplary structure shows the reference charge $V_{STD}$ as the ground charge. The structure is similarly formed when the reference charge is half of the supply voltage Vdd. Since the condition where C1+C2÷C3+C4=Cf is no longer necessary, the structure is simpler.

FIG. 5 shows an exemplary structure of the conventional multiplication circuit including accumulation using the neural multiplication circuit. In FIG. 5, all of $\mathbf{8}_1$, $\mathbf{8}_2$ . . . $\mathbf{8}_n$ are neural multiplication circuits above. The capacitance switching circuit in FIG. 4 is simplified and shown in this figure.

The number 9 in FIG. 5 shows a neural addition circuit for adding the outputs of the neural multiplication circuits $\mathbf{8}_1$ to $\mathbf{8}_n$. The neural addition circuit works similarly to the neural multiplication circuit, and outputs the output voltage corresponding to the sum of a plurality of input voltage inputted through the input capacitor $C_0$, having a plurality of the same capacities. Here, $n \cdot C_0=Cf$.

To the neural multiplication circuit $\mathbf{8}_1$, an analog voltage $X_1$ corresponding to the first data of the first input data string is impressed as an input voltage, and the first data $A_1$ of the second data string (m bit of $a_{1l}$ to $a_{1m}$) is input as a control signal. To the neural multiplication circuit $\mathbf{8}_2$, an analog voltage $X_2$ corresponding to the second element of the first input data string X is impressed as an input voltage, and the second data $A_2$ of the second data string A (m bit of $a_{2l}$ to $a_{2m}$) is inputted as a control signal. Similarly, a signal corresponding to the first input signal string X is impressed as an input voltage to the neural multiplication circuits $\mathbf{8}_3$ to $\mathbf{8}_n$, and the data of the order corresponding to the second data string A is inputted as a control signal. In each neural multiplication circuit $\mathbf{8}_1$ to $\mathbf{8}_n$, the multiplication of each input voltage and control signal is parallelly performed, and the output voltages $V_{81}$ to $V_{8n}$ of the results of each multiplication are obtained. As the computing time is the same as the multiplication time of one term because the multiplications of each form are parallelly performed, and, substantially, it is the propagation delay time in the multiplication amplifying circuit 13.

The multiplication results of each term to be outputted from each neural multiplication circuit $\mathbf{8}_1$ to $\mathbf{8}_n$ are parallelly inputted to the neural addition circuit 9. In the neural addition circuit 9, the multiplication results $V_{81}$ to $V_{8n}$ inputted from each neural multiplication circuits $\mathbf{8}_1$ to $\mathbf{8}_n$ are added and the multiplication and accumulation result Vout is outputted to the output terminal of the neural addition circuit 9. The necessary time for the addition in the addition circuit 9 is also substantially the same as the propagation delay time in the operational amplifier 13.

The inventors have filed Japanese patent applications with respect to multiplication circuits of the type of the multiplication circuit incorporated within an analog integrated circuit, such as Japanese open-laid publications 6-195483 and 6-215164, for realizing low-power analog multiplication circuits.

These multiplication circuits have the disadvantage that a rather long transient time is necessary until the input and feedback capacitances are charged to be a stable state, so the calculation speed is limited by the transient time. However, if the capacity of the input capacitance is decreased so as to decrease the transient time, the calculation accuracy is lowered. When "On" resistance of the MOS switch or MOS multiplexer is lower, the transient time decreases; however, the gate width of the MOS increases so that the resistance is low. It will cause MOS area increase as well as circuit density decrease.

SUMMARY OF THE INVENTION

It is possible to perform a high-speed multiplication including accumulation with a multiplication circuit using the neural computation circuit above. However, this multiplication circuit uses (n+1) number of operational amplifiers in the whole circuit and this contains substantial hardware.

The present invention has an object to provide an multiplication circuit that performs multiplication and accumulation with less hardware requisite.

A multiplication circuit of high calculation speed without deteriorating the calculation accuracy and circuit density can be provided.

To achieve the foregoing object, the multiplication circuit of the present invention is structured as below.

A multiplication circuit for performing multiplication including an accumulation of the first data string and the second data string each having n number of elements (n is a plus integer), comprising: 1) n number of capacitance switching circuits each consisting of: i) the first input terminal to be impressed an analog voltage corresponding to each element in the first input data string, ii) the second input terminal for inputting m bits of digital data corresponding to each element in the second input data string (m is a plus integer), a corresponding bit in the m bits of digital data inputted from the second input terminal is impressed as a control signal on the first and second analog switches, iii) m number of multiplexer circuits each of which has, a) the first analog switch provided between the first input terminal and the capacitance, and b) the second analog switch provided between the capacitance and a reference charge, iv) m number of capacitances each of which is connected to an output of the n number of multiplexer circuits, the capacitance of each having a capacity corresponding to the bit weight of the second input data, II) one operational amplifier having parallelly impressed outputs of the n number of capacitance switching circuits; and III) a feedback capacitance provided between the input terminal and the output terminal of the operational amplifier.

Also, the capacitance is formed on the semiconductor board.

As the analog voltage corresponding to each element in the first input data string is added through a capacitance with its capacity in response to the digital data which corresponds to each element of the second input data string, it is possible to parallelly perform multiplication and addition of the analog data corresponding to each element of the first input data string and that of the digital data corresponding to the second input data string, and also possible to use a single operational amplifier.

A multiplication circuit according to the present invention has MOS switch or MOS multiplexer the MOST of which has a agate with width and length so that a time constant defined by the input capacitance and the switch etc. is constant.

BRIEF DESCRIPTION OF THE DRAWINGS

FIG. 1(*a*) shows a multiplexer circuit.

PREFERRED EMBODIMENT OF THE PRESENT INVENTION

Figure 1:
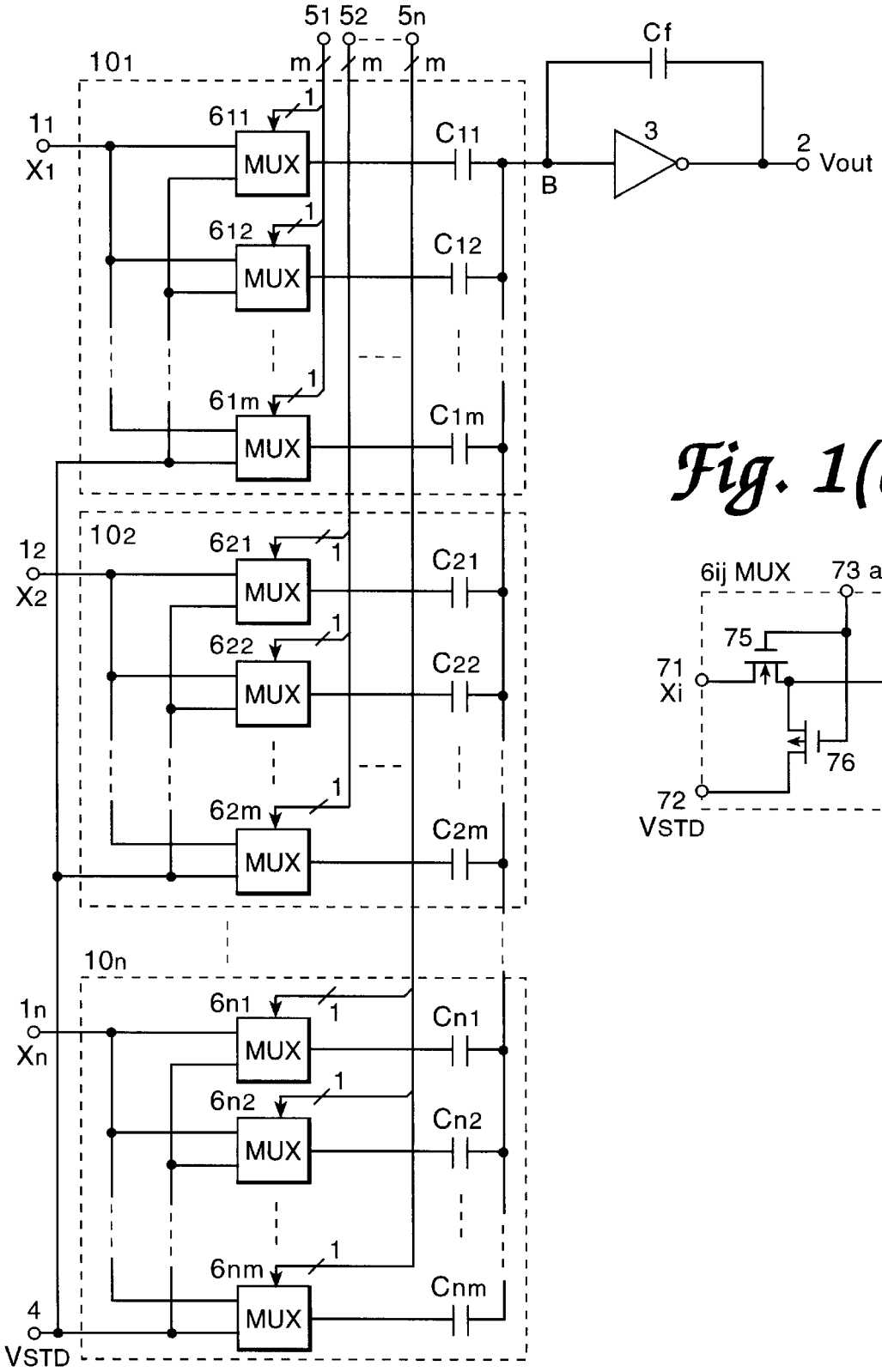
FIG. 1 shows an embodiment of the multiplication circuit of the present invention.
Figure 1A:
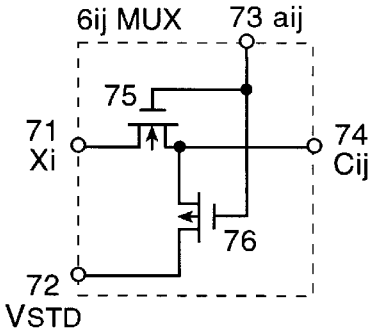
Figure 2:
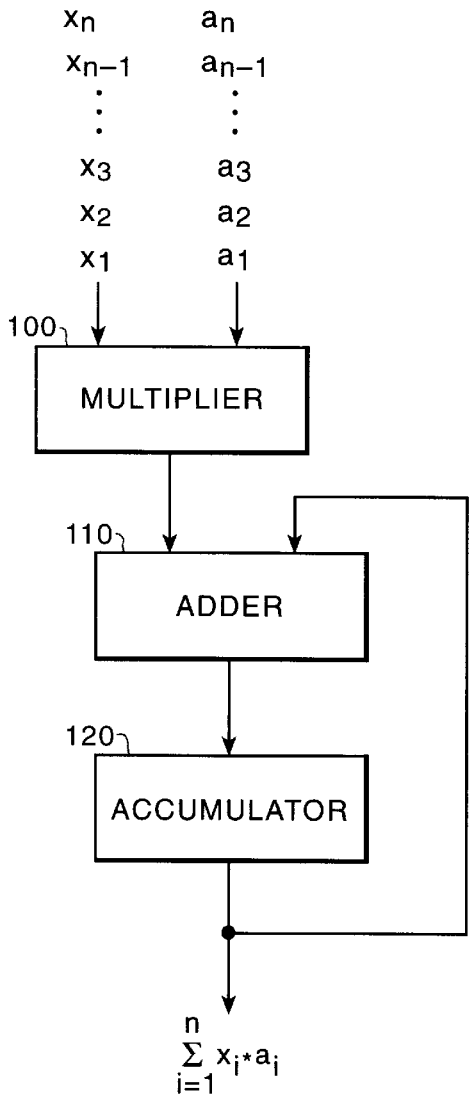
Fig. 2 PRIOR ART
FIG. 2 shows a conventional digital multiplication circuit.

FIG. 1 shows an embodiment of the multiplication circuit of the present invention. In FIG. 1, $\mathbf{1}_1$, $\mathbf{1}_2 \ldots \mathbf{1}_n$ show input terminals for inputting analog voltages $X_1$ to $X_n$, which are the elements of the first input data string X, 2 shows an output terminal for outputting an analog output voltage Vout corresponding to the result of the multiplication and accumulation, 4 shows the reference potential terminal to be connected to the reference potential, and $\mathbf{5}_1$, $\mathbf{5}_2 \ldots \mathbf{5}_n$ are the control data input terminals to be supplied control data $A_1$, $A_2 \ldots A_n$, which are the elements of the second input data string A. The control data $A_1, A_2 \ldots A_n$ are the digital data of m bit. Each bit is shown by $a_{ij}$ ($1 \leqq i \leqq n$, $1 \leqq j \leqq m$, hereinafter, with identical condition). $\mathbf{6}_{1l}$ to $\mathbf{6}_{nm}$ are multiplexer circuits whose details are provided later.

$C_{1l}$ to $C_{nm}$ are capacitances. Each of their input terminals is connected to the output of each multiplexer circuit $\mathbf{6}_{ij}$, and each of their output terminals is commonly connected and inputted to the operational amplifier 3. The first capacitance switching circuit $\mathbf{10}_1$ is structured by multiplexers $\mathbf{6}_{1l}$ to $\mathbf{6}_{1m}$ and capacitances $C_{1l}$ to $C_{1m}$ connected to the input terminal $\mathbf{1}_1$. The second capacitance switching circuit $\mathbf{10}_2$ is structured by multiplexers $\mathbf{6}_{2l}$ to $\mathbf{6}_{2m}$ and capacitances $C_{2l}$ to $C_{2m}$ connected to the input terminal $\mathbf{1}_2$. Similarly, the n-th capacitance switching circuit $\mathbf{10}_n$ is structured by multiplexers $\mathbf{6}_{nl}$ to $\mathbf{6}_{nm}$ and capacitances $C_{nl}$ to $C_{nm}$ connected to input terminal $\mathbf{1}_n$. These capacitances are formed on a semiconductor board.

Figure 3A:
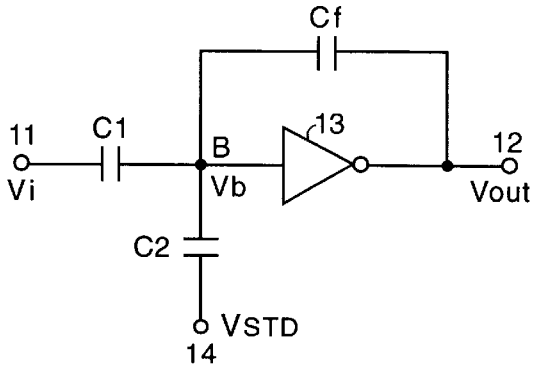
FIGS. 3(*a*) and (*b*) show neural multiplication circuits.
Figure 3B:
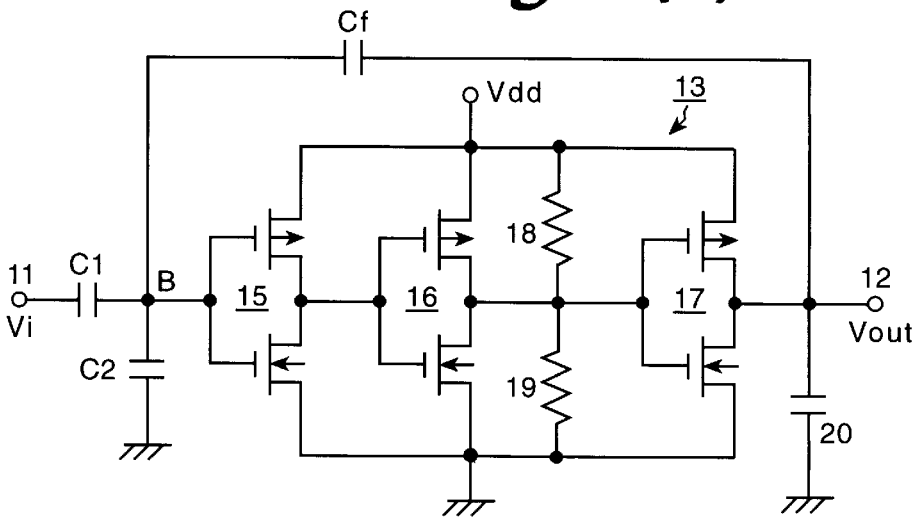
Figure 4:
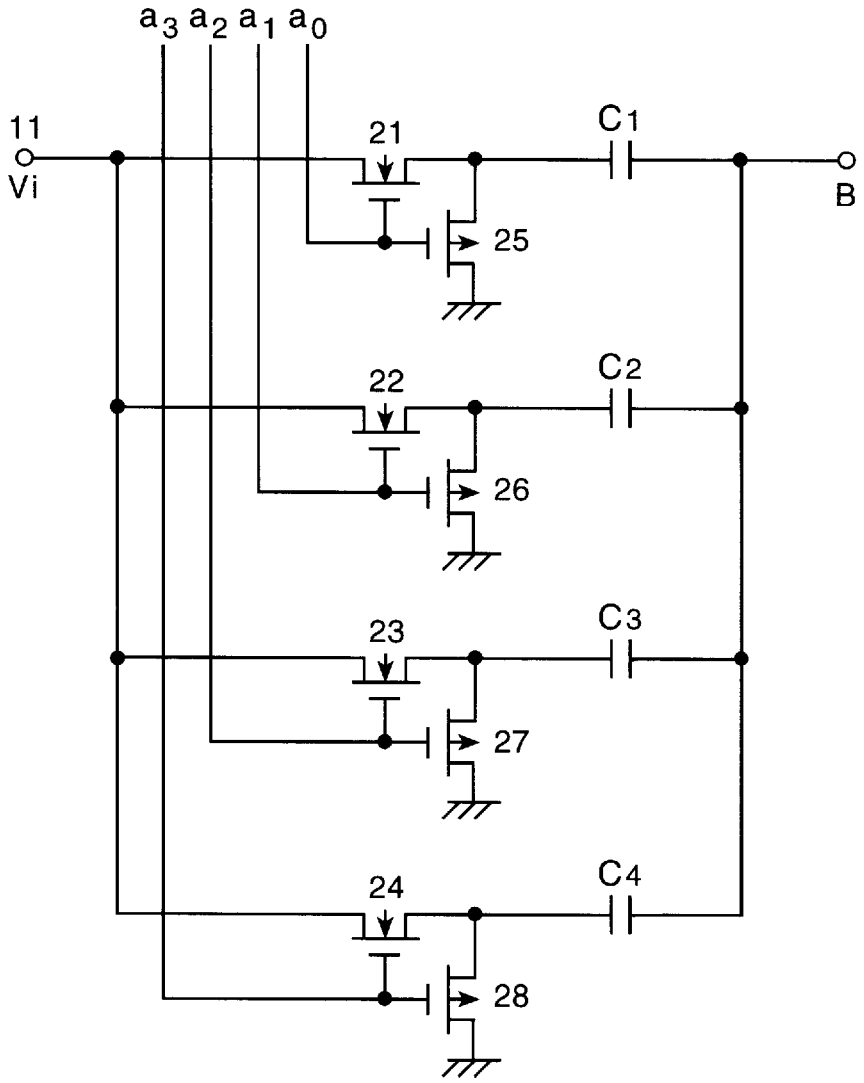
FIG. 4 shows a capacitance switching circuit.
Figure 5:
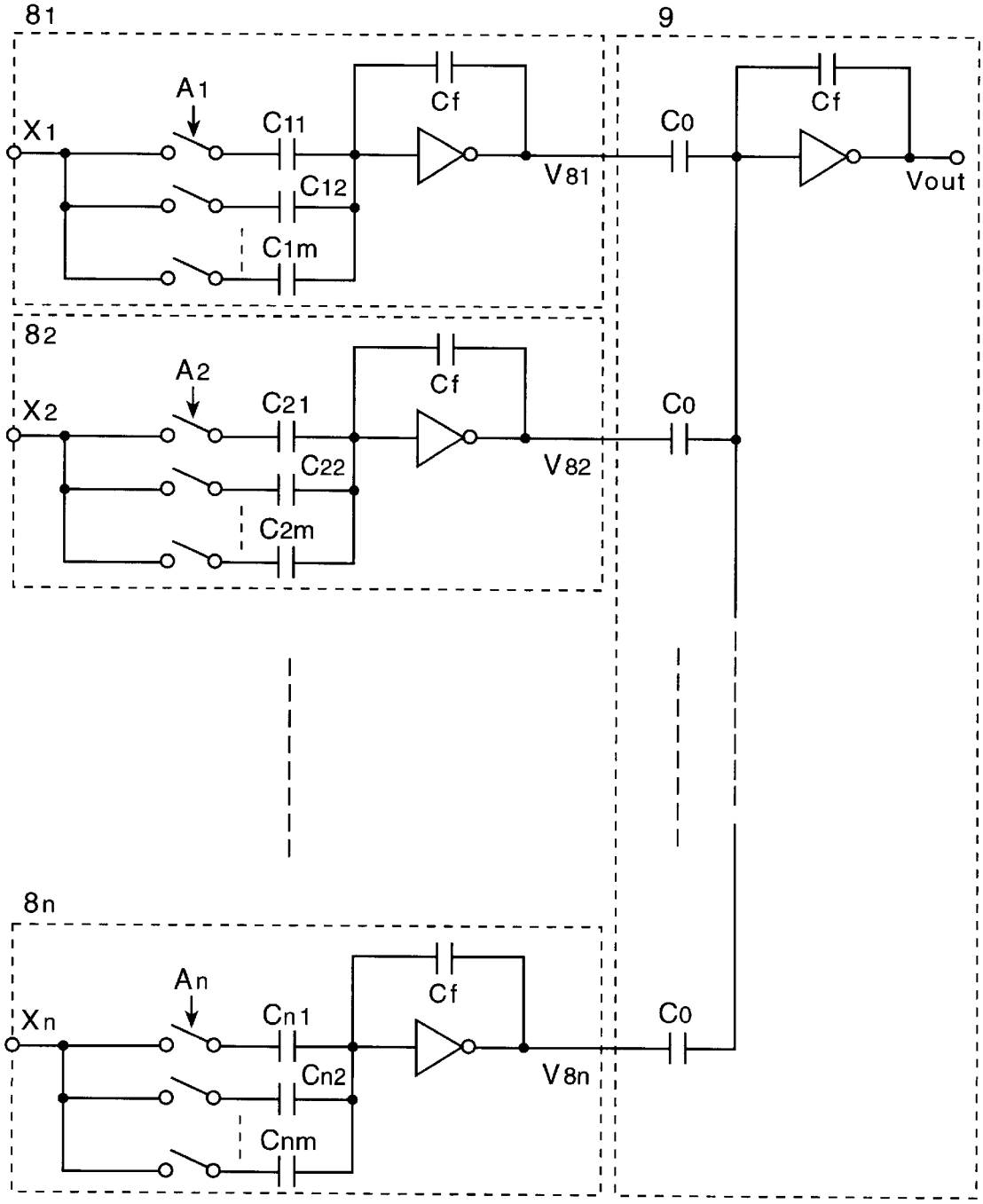
Fig. 5 PRIOR ART
FIG. 5 shows a conventional multiplication circuit using neural multiplication circuits.

Part 3 is an operational amplifier. The outputs of capacitance switching circuits $\mathbf{10}_1$ to $\mathbf{10}_n$ are parallelly connected to the input terminal. The operational amplifier 3 is realized by CMOS inverters serially connected with an odd number of stages, for example three stages, as described in FIG. 3(*b*).

A feedback capacitance Cf is connected between the output and input of the operational amplifier 3. Part 2 is an output terminal connected to the output of the operational amplifier 3.

The structure of each multiplexer circuit $6_{ij}$ is shown in FIG. 1(*a*), where the multiplexer $6_{ij}$ includes a terminal 71 connected to an input terminal $1_i$ to be impressed the analog input voltage $X_i$, a terminal 72 connected to the reference potential terminal 2, control signal terminal 73 to be impressed the j-th bit $a_{ij}$ of a control signal $A_i$ of the second input data, a terminal 74 connected to the corresponding capacitance $C_{ij}$, an n type MOSFET 75 and a p type MOSFET 76. MOSFETs 75 and 76 works as analog switches. When the control data $a_{ij}$ to be impressed on the terminal 73 is high level, the n type MOSFET 75 is conductive, the p type MOSFET 76 is not conductive, and the capacitance $C_{ij}$ connected to the terminal 74 is connected to an input terminal $X_i$. When the control data $a_{ij}$ to be impressed on the terminal 73 is low level, the n type MOSFET 75 is not conductive, the p type MOSFET 76 is conductive and the capacitance $C_{ij}$ is connected to the reference potential through the terminal 72.

The structure of the analog switch is not limited to that shown in the figure. It can be a transmission gate of a CMOS.

Each capacitance $C_{1l}$ to $C_{nm}$ has a capacity using a capacity ratio according to the bit weights of the control data $A_i$ ($a_0$ to $a_m$) connected to them. This capacity ratio is shown in formula (7).

$$C_{1m}-2C_{lm-1}=2^2C_{lm-2}=\ldots=2^{nl-1}C_{l2}=2^{ml-1}C_{l1} \tag{7}$$

All of the capacities of the capacitances corresponding to each capacitance switching circuit $10_1$ to $10_n$ are equal. That is, $C_{1l}=C_{2l}=\ldots=C_{n1}$.

In a circuit with this structure, the initial condition of the electrical charge stored in all the capacitances is 0, similar to the above case. Therefore, formula (8) is true by virtue of the electrical charge retention law. It is likewise assumed that the electrical charge of point B on the input side of the operational amplifier 3 is Vb, and Vb=(½)Vdd.

$$\sum_{i=1}^{n}\sum_{j=1}^{m} C_{ij}a_{ij}(x_i - Vb) + \sum_{i=1}^{n}\sum_{j=1}^{m} C_{ij}(1-a_{ij})(V_{STD}-Vb) + Cf(V\text{out} - Vb) = 0 \tag{8}$$

Here, the control data $a_{ij}$ is the digital data of "0" or "1".

Where the reference potential $V_{STD}$ is the ground potential ($V_{STD}$=0), and the sum of the capacities of all the capacitances $C_{ij}$ is equal to the capacity of the feedback capacitance Cf, formula (9) ensues:

$$\sum_{i=1}^{n}\sum_{j=1}^{m} C_{ij} = Cf \tag{9}$$

In this case, formula (8) comes to be formula (10):

$$\sum_{i=1}^{n}\sum_{j=1}^{m} C_{ij}a_{ij}(x_i - Vb) + \sum_{i=1}^{n}\sum_{j=1}^{m} C_{ij}(1-a_{ij})(0-Vb) + Cf(V\text{out} - Vb) = 0 \tag{10}$$

Using the equation $C_{ij}=2^{j-1}C_{ij}$ in formula (8) and in formula (9), formula (11) then derives from formula (10):

$$V\text{out} = 2Vb - \frac{\sum_{i=1}^{n} C_{i1}x_i \sum_{j=1}^{m} 2^{j-1}a_{ij}}{\sum_{i-1}^{a} C_{i1}\sum_{j-1}^{m} 2^{j-1}} = 2Vb - \frac{\sum_{i=1}^{n} x_i \sum_{j=1}^{m} 2^{j-1}a_{ij}}{n(2^m-1)} \tag{11}$$

The circuit can now perform multiplication and addition of an analog input voltage Xi and control data Ai.

Where the reference potential $V_{STD}$ is set at to (½)Vdd (=Vb), formula (12) is derived from formula (8).

$$\sum_{i=1}^{n}\sum_{j=1}^{m} C_{ij}a_{ij}(x_i - Vb) + Cf(V\text{out} - Vb) = 0 \tag{12}$$

Here, each voltage is replaced by the voltage referencing Vb, assuming input voltage to be $X'_1=X_1_Vb$ and output voltage to be V'out=Vout−Vb.

Where the sum of the capacities of all the capacitances $C_{ij}$ is assumed to be equal to the capacity of the feedback capacitance Cf, and the equation in formula (9) assumed to be true, formula (12) can be expressed as formula (13).

$$V'\text{out} = -\frac{\sum_{i=1}^{n} x'_i \sum_{j=1}^{m} 2^{j-1}a_{ij}}{n(2^m-1)} \tag{13}$$

The multiplication and addition of the input voltage $X'_i$ and the control data $A_i$ having the referencing voltage Vb can be performed as above.

When the equation in formula (9) is not true, formula (12) is transformed into formula (14):

$$V'\text{out} = -\frac{\sum_{i=1}^{n} C_{i1}x'_i \sum_{j=1}^{m} 2^{j-1}a_{ij}}{Cf} \tag{14}$$

Here, $C_{1l}=C_{2l}=\ldots=C_{nl}$ as above, the formula (14) can be expressed as formula (15).

$$V'\text{out} = -\frac{C_{11}}{Cf}\sum_{i=1}^{n} x'_i \sum_{j=1}^{m} 2^{j-i}a_{ij} \tag{15}$$

Therefore, the multiplication and accumulation of the input voltage $X'_1$ and the control data $A_i$ is similarly performed in this case as well.

The present invention's circuit can accomplish the multiplication and assumulation. The time necessary for the computation is approximately as short as the propagation delay time of the operational amplifier 6. The electric power consumption is very low because it is driven only by the voltage.

Hereinafter, the second embodiment is described.

Figure 6:
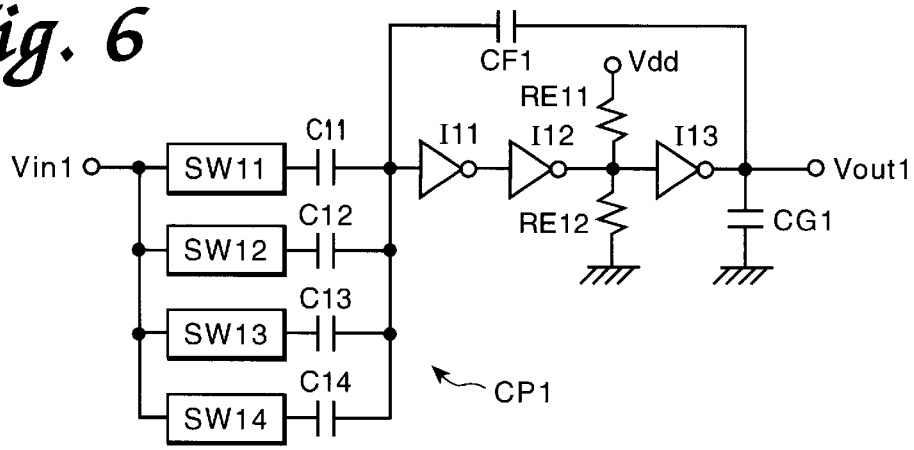
FIG. 6 is a circuit diagram showing the second embodiment of a multiplication circuit according to the present invention.

FIG. 6 shows the second embodiment of a multiplication circuit including a plurality of input capacitances C11 to C14, outputs of which are commonly connected to a capacitive coupling CP1. A plurality of MOS switches SW11 to SW14 are provided corresponding to the input capacitances, each of which is connected an input of the corresponding input capacitance. An input voltage Vin1 is commonly connected to inputs of the switches. The input voltage is impressed through a closed switch to the input capacitance. Outputs of the total input capacitances are connected to an input of an inverter circuit having an odd number of MOS inverters I11, I12 and I13 serially connected. The output of the last stage MOS inverter I13 is connected through a feedback capacitance CF1 to an input of the first stage MOS inverter I11.

The inverter circuit has a good linearity in the relationship between its input and output because of a high open-loop gain of the MOS inverters I11 to I13 and the feedback by the feedback capacitance CF1. When input voltages impressed to the capacitances C11 to C14 are V1, V2, V3 and V4, and the threshold voltage of the inverters I1 to I3 is Vb, the output voltage Vout1 of the MOS inverter circuit is as follows.

$$Vout1 = Vdd - \frac{\sum_{i=1}^{4} C1i}{CF1} Vin1 \tag{16}$$

When a ratio of capacitances is applied as in formulas (17) and (18), a normalized multiplication result of Vin1 multiplied by a binary number.

$$\sum_{i=1}^{4} C1i = CF1 \tag{17}$$

$$C1i = 2^{i-1} \tag{18}$$

The MOS inverter circuit has a grounded capacitance CG1 and balancing resistances RE11 and RE12. The grounded capacitance performs as a low-pass filter, and the balancing resistance performs as load to decrease a gain of the inverter circuit. These components prevent unstable oscillation of the high-gain circuit including a feedback loop of the feedback capacitance.

Figure 7:
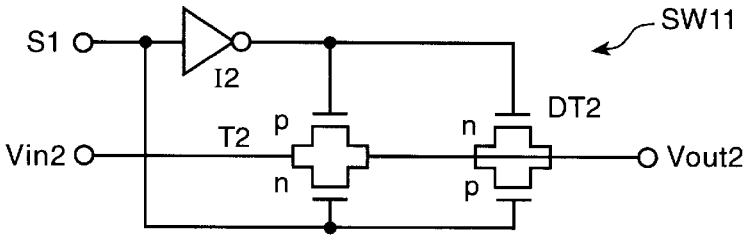
FIG. 7 is a circuit diagram showing a switch in FIG. 6.

In FIG. 7, the switch SW11 has a transistor circuit T2 with an n-type MOS transistor and a p-type MOS transistor, a drain of one transistor is connected to a source of the other transistor. As input voltage Vin2 is connected to a drain of the nMOS, and a source of the nMOS is connected through a dummy transistor DT2 to an output terminal Vout2. The dummy transistor DT2 is similar to the transistor circuit T2 but different from T2 in that the drain and source of each type MOS is short-circuited. A control signal S1 is input to a gate of the nMOS of the transistor circuit T2, and the control signal S1 is inverted by an inverter T2 to be input to a gate of the pMOS. The circuit T2 is conductive when S1 is high level and cut off when low level. Since SW12 to SW14 are the same as SW11, descriptions therefor are omitted.

A time constant of a circuit of each switch and the input capacitance connected to the switch is given by "ON" resistance of the switch and capacity of the input capacitance. When the "ON" resistances are R11, R12, R13 and R14 for the switches SW11 to SW14, respectively, the time constants are C11.R11, C12.R12, C13.R13 and C14.R14. The length of the calculation time depends on these time constants. The "ON" resistance is in direct proportion to the length of the gate of the MOSs and in inverse proportion to the width of the gate.

The time constants can be set for the input capacitances independently from one another, however, the calculation time is determined only by the longest time constant, so it is advantageous to define the time constants equal to one another. Circuit density and the calculation speed are totally optimized. The gate length is usually designed to be minimum. Each resistance is determined by adjusting only the gate width.

Figure 8:
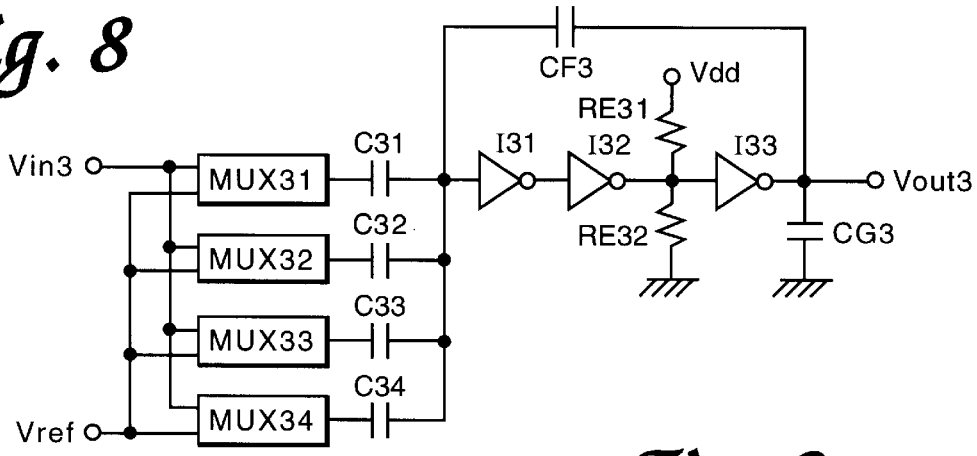
FIG. 8 is a circuit diagram of the third embodiment.

FIG. 8 shows the third embodiment in which MOS multiplexers MUX31, MUX32, MUX33 and MUX34, substitute for the MOS switches of the first embodiment. Other components of the second embodiment are the same as those of the second embodiment. The same or corresponding components of the second embodiment are designated by reference numbers which include the number "3" at positions where the number "1" is used in the reference number of the corresponding components in the second embodiment. The third embodiment consists of input capacitances C31, C32, C33 and C34, MOS inverters I31, I32 and I33, a feedback capacitance CF3, a grounded capacitance CG3 and balancing resistances RE31 and RE32.

Figure 9:
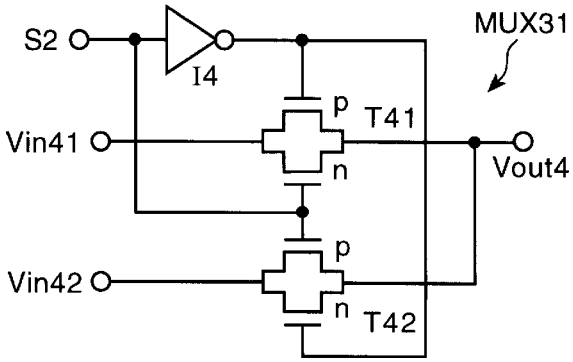
FIG. 9 is a circuit diagram showing a multiplexer in FIG. 8.

As shown in FIG. 9, the multiplexer MUX31 has transistor circuits T41 and T42, each of which consists of an n-type MOS transistor and a p-type MOS transistor. In each transistor circuit, a drain of one transistor is connected to a source of the other. An input voltage Vin3 (designated by Vin41 in FIG. 9) is connected to a drain of the nMOS of circuit T4), and a reference voltage Vr (designated by Vin42 in FIG. 9) is connected to a drain of the nMOS of circuit T42. Sources of the nMOSs of circuits T41 and T42 are connected to a common output terminal Vout4. A control signal S2 is input to a gate of the nMOS of transistor circuit T41 and of the pMOS of transistor circuit T42. Control signal S2 is inverted by inverter 14 to be input to a gate of the pMOS of T41 and of the nMOS of T42. Circuit T41 is conductive and T42 is cut off when S2 is high level, while circuit T41 is cut off and T42 is conductive when low level. Therefore, MUX31 outputs Vin3 or Vr alternatively in response to control signal S2.

When the "ON" resistance of T41 connected to Vin41 (Vin3) is R1, the time constant is R1.C31, similarly to the second embodiment R1 is determined by the width and length of the gates of the MOSs. The "ON" resistance of T41 is dominant when Vin41 (Vin3) is output, and the "ON" resistance of T42 is dominant when Vin42 (Vr) is output. Therefore, each resistance is to be set equivalent to the other. The multiplexers MUX32 to MUX34 should have their "ON" resistances equivalent to the "ON" resistance of MUX31. Since MUX32 to MUX34 are the same as MUX31, descriptions therefor are omitted.

Figure 10:
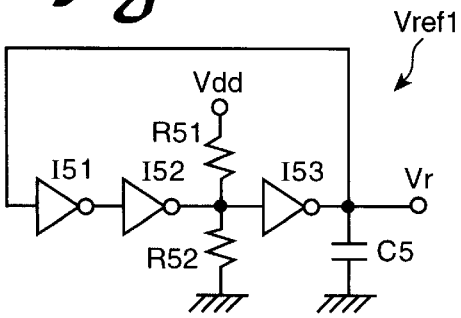
FIG. 10 is a circuit diagram showing a reference voltage generating circuit.

The reference voltage Vr is generated by a reference voltage-generating circuit Vref shown in FIG. 10. The circuit has three stages of MOS inverters I51, I52 and I53 serially connected. An output of the final stage I53 is fed back to an input of the first stage I51. A grounded capacitance C5 and balancing resistances R51 and R52 are connected similarly to the circuits above for preventing unstable oscillation. The circuit Vref converges to a status that its input and output are equal to each other. The output voltage Vref is determined by the thresholds of MOS inverters I51 to I53. Generally, in order to maximize the dynamic range in both the positive and negative directions, the threshold is set to be Vdd/2, which causes the output voltage Vr=Vdd/2. Here, Vdd is a supply voltage of the MOS inverters.

ADVANTAGES OF THE PRESENT INVENTION

As mentioned above, it is possible to provide a multiplication circuit which performs multiplication including accumulation using only one operational amplifier with the present invention.

A multiplication circuit according to the present invention has a MOS switch or MOS multiplexer the MOS of which has a gate with width and length so that a time constant defined by the input capacitance and the switch etc. is constant.

Therefore, high calculation speed is obtained without deteriorating the calculation accuracy and circuit density.

What is claimed is:

1. A multiplication circuit for performing multiplication with accumulation of the first data string and the second data string, each having n number of elements (n is a plus integer), comprising:

I) n number of capacitance switching circuits each consisting of;

i) the first input terminal to be impressed an analog voltage corresponding to each said element in said first input data string, ii) the second input terminal for inputting m bits of digital data corresponding to each said element in said second input data string (m is a plus integer), a corresponding bit in said m bits of digital data inputted from said second input terminal is impressed as a control signal on said first and second analog switches, iii) m number of multiplexer circuits each of which has, a) the first analog switch provided between said first input terminal and said capacitance, and b) the second analog switch provided between said capacitance and a reference charge, iv) m number of capacitances each of which is connected to an output of said n number of multiplexer circuits, the capacitance of each having a capacity corresponding to the bit weight of said second input data, II) one operational amplifier having parallelly impressed outputs of said n number of capacitance switching circuits; and III) a feedback capacitance provided between the input terminal and the output terminal of said operational amplifier.

2. A multiplication circuit as claimed in claim 1, wherein said capacitance is formed on a semiconductor board.

* * * * *